United States Patent [19]

Asano

[11] Patent Number: 5,011,448

[45] Date of Patent: Apr. 30, 1991

[54] SPIRAL-SPRING-DRIVEN DOLL TOY

[76] Inventor: Kiyoji Asano, No. 2-14, Mibu-cho, Omochanomachi, 2-chome, Shimotsuga-gun, Tochigi-ken, Japan

[21] Appl. No.: 445,749

[22] Filed: Dec. 4, 1989

[30] Foreign Application Priority Data

Dec. 9, 1988 [JP] Japan ..... 63-159408[U]
Jul. 28, 1989 [JP] Japan ..... 1-88032[U]

[51] Int. Cl.[5] ..... A63H 11/10
[52] U.S. Cl. ..... 446/293; 446/354
[58] Field of Search ..... 446/289, 290, 293, 464, 446/276, 279, 280, 285, 292, 294, 353, 354, 355

[56] References Cited

U.S. PATENT DOCUMENTS 3,050,900 8/1962 Glass et al. ..... 446/293 X
4,469,197 9/1984 Minoru ..... 446/464 X
4,623,039 11/1986 Itoh ..... 446/464 X

FOREIGN PATENT DOCUMENTS 222181 12/1984 Japan ..... 446/289

*Primary Examiner*—Mickey Yu

[57] ABSTRACT

The spiral-spring driven doll toy according to the invention includes a driving mechanism in which a spiral spring is wound up via a gear mechanism by backward rotation of a driving wheel and then provides the restoring force which causes the wheel to rotate. Two leg portions of the doll toy are each rotatably driven by a driving wheel which has a wheel pin which engages in a groove on the leg portion and are similarly interlocked with two pivotable arm portions so that the leg portions move to and fro opposite to the arm portions.

3 Claims, 5 Drawing Sheets

SPIRAL-SPRING-DRIVEN DOLL TOY

BACKGROUND OF THE INVENTION

The present invention relates to a doll toy driven by a pull-back type spiral spring.

A conventional toy device is known having a driving mechanism in which backward rotation of wheels winds a spiral spring through a gear mechanism and the wound spiral spring provides restoring force for forward rotation of wheels. This type of mechanism is referred to as a pull-back system, and is mainly used for four-wheel toys.

SUMMARY OF THE INVENTION

It is a general object of the invention to provide a pull-back-system-driven doll toy. The invention consists of a spiral-spring-driven doll toy including a driving mechanism wherein backward rotation of wheels winds a spiral spring via a gear mechanism and the wound spiral spring provides restoring force for forward rotation of the wheels. This doll toy comprises driven wheels rotated by the action of a spiral spring held in a housing and a gear mechanism, leg portions rotatably supported on each side portion of the housing, and arm portions rotatably supported on the top of the housing.

The driving wheel has a wheel shaft and a wheel pin eccentric to the wheel shaft. The wheel pin is engaged with the leg portions so that the leg portions may be moved to and fro together by and with of the driving wheel.

The leg portion has a crank which is engaged with engaging pieces contained on a rotating shaft of the arm portions. The leg portion is therefore moved so that each arm portion moves in an opposite manner to each leg portion.

It is a further object of the invention to provide a spiral-spring-driven doll toy including a compact driving mechanism. The gear mechanism held in a housing comprises a first gear linked to a spiral spring, a second gear fixed on the driving wheel shaft, a third gear mating with the second gear, a fourth gear being engageable with the first and third gears, and a fifth gear being engageable with the first and third gears.

The fourth and fifth gears are displaceable. When the driving wheel is rotated backward, the fifth gear is engaged with the third and first gears so as to allow these gears to wind the spiral spring and the fourth gear is detached from the third gear so that it is run idle. When the spiral spring provides the restoring force which causes the first gear to be reversely rotated, the fifth gear is detached from the first gear and the fourth gear engages with the first and third gears. It results in the second gear rotating the driving wheel.

It is another object of the invention to provide a driven doll toy having the above-mentioned gears held in a housing in which the fifth gear is rotatably fitted on only one side wall of the housing. An opposite surface of the fitted portion is pressed by a step formed axially in the first gear in a manner to allow the fifth gear to be rotated.

BRIEF DESCRIPTION OF THE DRAWINGS

The objects, features and advantages of the present invention will now be illustrated in more detail by the following detailed description, reference being made to the accompanying drawing in which.

DESCRIPTION OF THE PREFERRED EMBODIMENT

Hereinafter, an embodiment of the invention is set forth with reference to the appended drawings.

Figure 1:
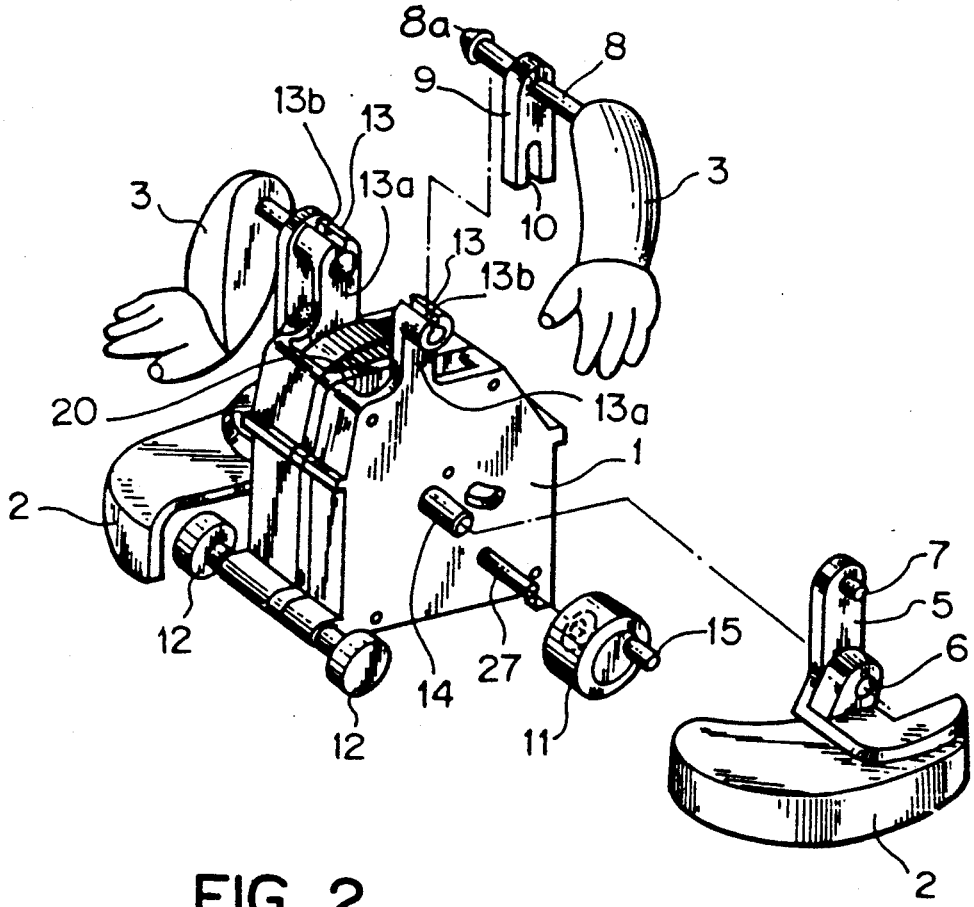
FIG. 1 is an exploded perspective view showing an embodiment of the invention.
Figure 2:
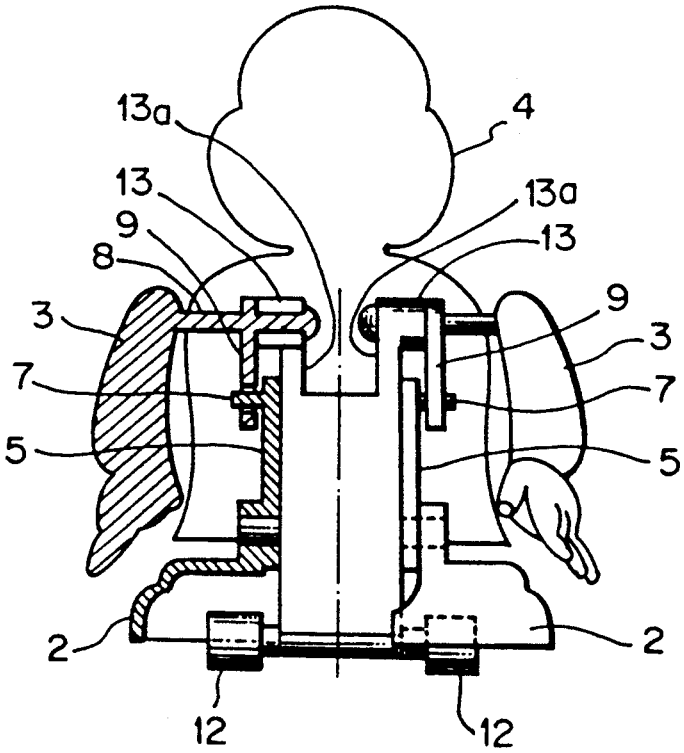
FIG. 2 is a partially-cut away elevation view showing the embodiment.
Figure 3:
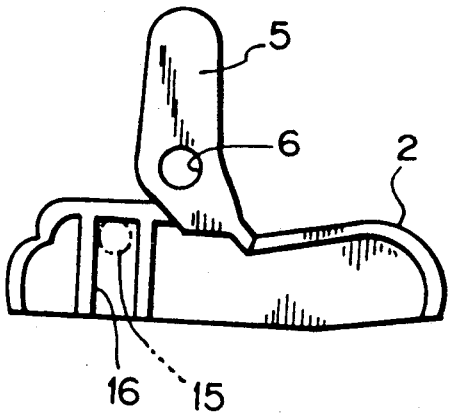
FIG. 3 is a rear view of a leg portion.

FIG. 1 shows the structure of the doll toy according to that embodiment. 1 denotes a housing holding a driving mechanism, 2 denotes a leg portion and 3 denotes an arm portion. The housing 1 has a hollow doll body 4 capped thereon as shown in FIG. 2. The doll body 4 consists of two front and rear parts (not shown), which are screwed to each other.

The leg portion 2 has a crank 5 integrally formed thereon. The crank extends upward and provides a hole 6 in a lower portion thereof and a fixed pin projecting from an upper portion thereof. The arm portion 3 has a rotating arm shaft 8 fixed thereon, which arm shaft 8 extends horizontally. The arm shaft 8 also provides an engaging piece 9 fixed on the middle portion thereof, which engaging piece 9 contains a recess 10. The arm portion 3, the rotating shaft 8, and the engaging piece are integrally formed.

On the other hand, the housing 1 provides a supporting arm **13*a* projected at the upper end portion thereof. The supporting arm 13*a* contains a bearing 13 with a cut-away portion 13*b* at the upper end portion thereof. The bearing 13 is engaged with the rotating arm shaft 8 of the arm portion 3. A shaft 14 is projected on the almost central portion of the outside of the housing 1 and engages in the hole 6 of the leg portion. This arrangement allows the leg portion 2 and the arm portion 3 to be rotated to and fro against the doll body and the fixed leg pin 7 of the crank 5 of the leg portion 2 to be engaged with the recess 10 of the engaging piece 9 of the arm portion 3 for interlocking the leg portion 2 with the arm portion 3. Each arm shaft 8 has a stop 8*a* on its free end which prevents the arm portion 3 from sliding out of the housing 1**.

The housing 1 includes a driving wheel 11 to be rotated by a driving mechanism (to be described later) and a driven wheel 12. The driving wheel 11 has a fixed wheel pin 15 projected in an eccentric manner to a wheel 27 on which the driving wheel 11 is mounted shaft. The fixed wheel pin 15 comes into engagement with a longitudinal groove 16 formed on the back surface surface of the leg portion 2 in a manner to allow the fixed pin 15 to be vertically slid.

Figure 4:
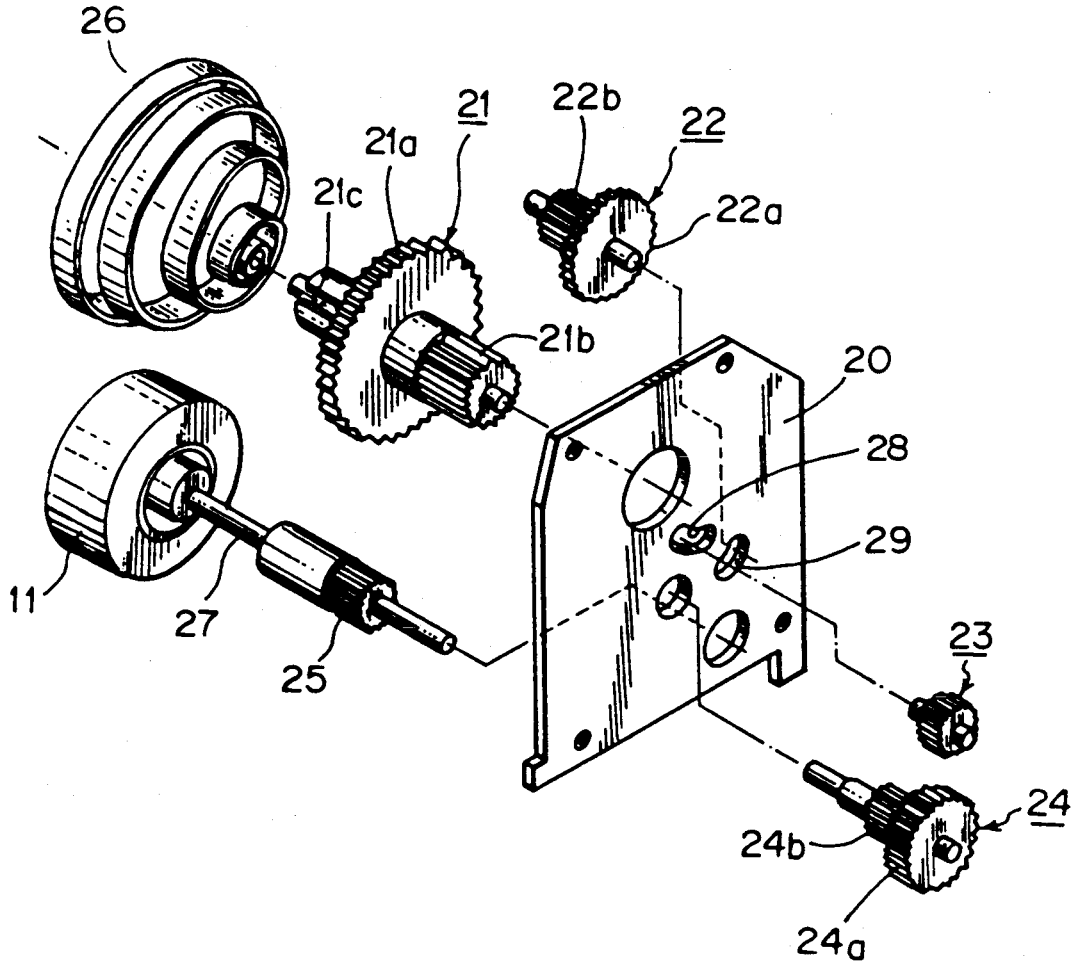
FIG. 4 is an exploded perspective view of a driving mechanism held in a housing.

FIG. 4 is an exploded view showing the driving mechanism held in the housing 1. 20 denotes a partition plate located in the middle of the housing 1, 21 denotes a first gear having an expanding slot 21 at its one end, which slot comes into engagement with a central end portion of a spiral spring 26. A second gear 25 is fixed on the wheel shaft 27 on which the driving wheel 11 is mounted. The housing 1 also contains a third gear 24, a fourth gear 22 and a fifth gear 23.

The first gear 21 contains a larger diameter gear 21*a* which is engaged with a smaller diameter gear 22*b* of the fourth gear 22. The first gear 21 has a smaller diameter gear 21*b* which passes through the partition plate 20 engageable with the fifth gear 23. And, the fourth gear 22 contains a larger diameter gear 22*a* which is allowed to be engaged with a smaller diameter gear 24*b* of the third gear which passes through the partition plate 20. The third gear 24 contains a larger diameter gear 24*a*, which is engageable with the second gear passing through the partition plate 20 as well as with the fifth gear 23.

The first, second, and third gears have respective rotating shafts which are mounted on both side walls of the housing 1. The fourth and fifth gears 22 and 23 have respective rotating shafts which are mounted between the partition plate 20 and one side wall of the housing 1 (which is a left side wall viewed in FIG. 4 for the fourth gear and a right side wall for the fifth gear, though not shown). The rotating shafts of the fourth gear 22 and the fifth gear 23 are inserted into slots 28, 29 (the same slot is formed on the side wall of the housing 1, though not shown) so that these rotating shafts may be displaced in accordance with the rotation of the gears engaged with these gears 22, 23.

Next, the operation of this invention is described.

Figure 6:
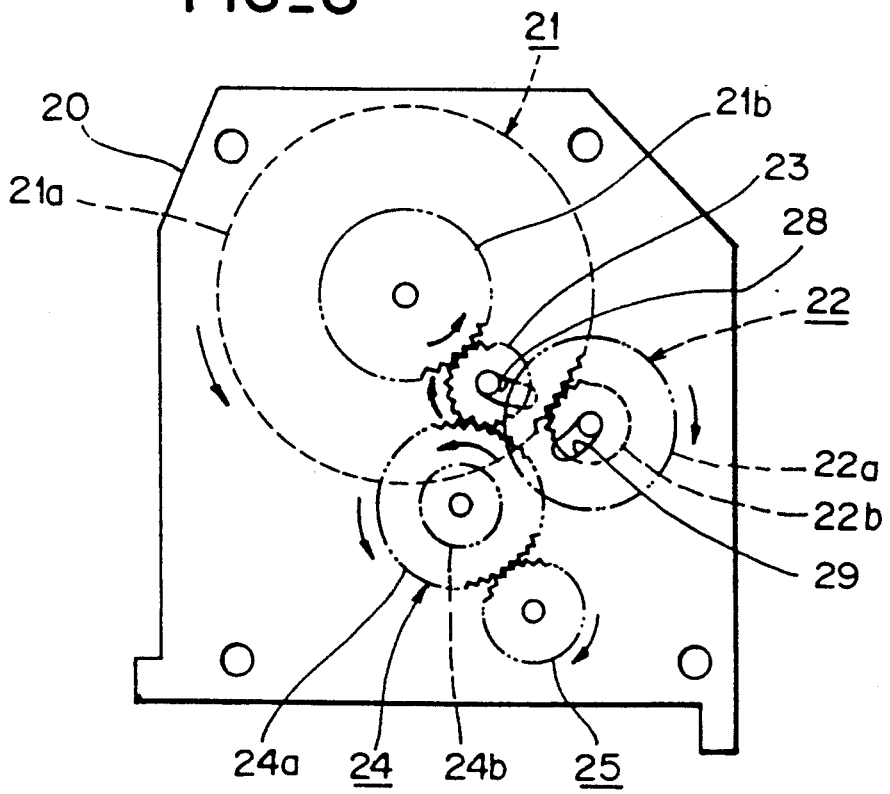

At first, assuming that the driving wheel 11 is rotated by virtue of friction caused on a floor, as shown in FIG. 6, the second gear 25 and the third gear 24 are in the direction of the arrows. The fifth gear 23 in then pulled along the slot 28 the rotation of the third gear 24. This rotates the first gear 21 and winds the spiral spring 26. At this time, the fourth gear 22, which is engaged with the larger diameter portion 21*a* of the first gear, is pressed up along the slot 29 rotation of the first gear, thereby the larger diameter portion 22*a* being disengaged from the third gear 24 thus bringing the fourth gear 22 into an idling state.

Figure 5:
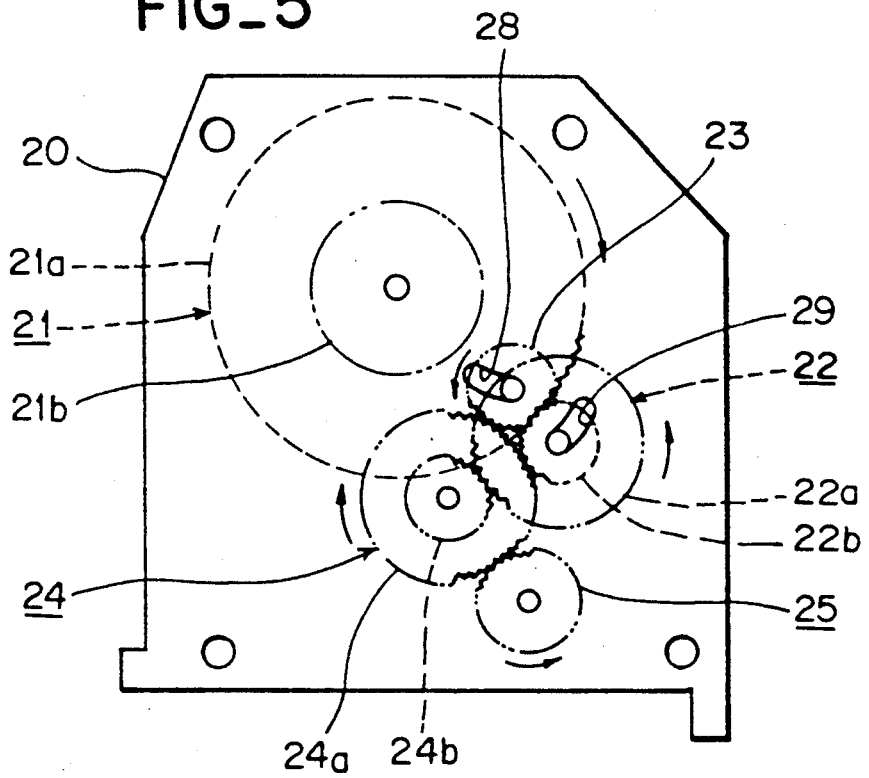
FIGS. 5 and 6 are schematic cross sectional views showing the operation of gears.

When a user releases the doll toy after the spiral spring 26 is wound up, the spiral spring 26 provides restoring force which causes the first gear to be reversely rotated in the direction of an arrow as shown in FIG. 5. With this reverse rotation, the fourth gear 22 is displaced downward along the slot 29 and the larger diameter portion of the fourth gear 22 is engaged with the smaller diameter portion 24*b* of the third gear, rotating the third gear 24, rotating the second gear 25 in the direction of the arrow, and rotating the driving wheel 11 forward. At this time, the fifth gear 23 is displaced to the right hand with the rotation of the third gear 24 so that it is disengaged from the smaller diameter portion 21*b* of the first gear, resulting in the fifth gear 23 being engaged with only the larger diameter portion 24*a* of the third gear 24 thus bringing the fifth gear 23 into an idling state.

With the rotation of the driving wheel 11, the wheel pin 15 is eccentrically rotated. Then, the leg portion 2 engaged with the wheel pin is moved to and fro. And, with the longitudinal movement of the leg portion 2, the arm portion 3 is allowed to move to and fro through the effect of the leg pin 7 of the crank 2 and the cam engaged with the leg pin 7.

As the doll toy main body travels with rotation of the driving wheel 11, the leg portion 2 and the arm portion 3 are moved to and fro in an opposite manner to each other.

In addition, according to the invention, the character depicted by the main body 4 may be optionally selected. It is better to select an animal character with hands and/or paws.

Figure 7:
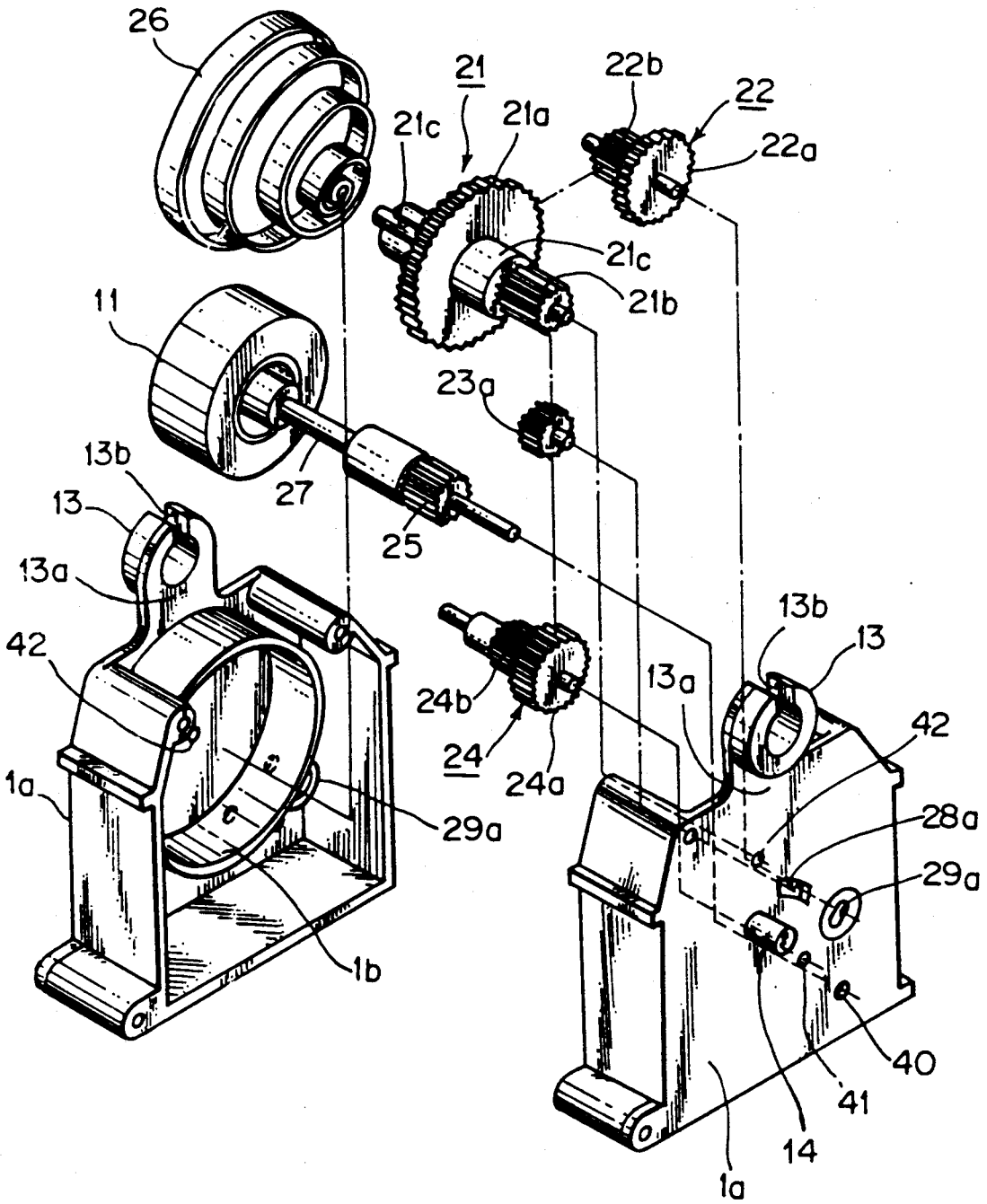
FIG. 7 is an exploded perspective view of another embodiment of a driving mechanism held in a housing and FIGS. 8 and 9 are schematic cross sectional views showing the operation of gears according to the embodiment of FIG. 7.
Figure 9:
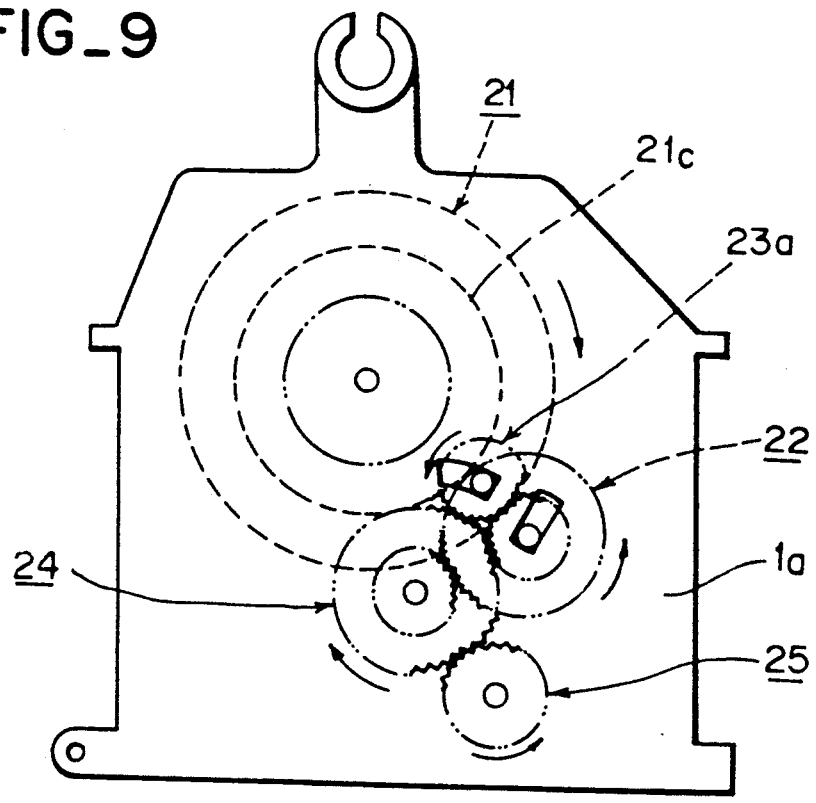

FIGS. 7 and 9 show another embodiment of the invention.

The embodiment shown in FIGS. 1 to 6 provided the partition plate 20 in the gear housing 1 and the fourth gear 22 and the fifth gear 23 fitted between the partition plate 20 and the side wall of the gear housing 1, while this embodiment is designed to eliminate the partition plate 20 and change the design of middle gears.

As shown in FIG. 7, this embodiment has a housing 1 consisting of right and left side frames 1*a* and is designed to allow the rotating shaft of a first gear 21 to be inserted into a hole 42 on the side frame 1*a*, a wheel shaft 27 having a second gear 25 fixed thereon to be inserted into a hole 40, the rotating shaft of a third gear 24 to be inserted into a hole 41 the rotating shaft of a fourth gear 22 to be inserted into a hole 29*a*, and the rotating shaft of a fifth gear 23*a* to be inserted into a hole 28*a*.

A bearing portion is provided on the inside of the hole 29*a* of the fifth gear 22 and supports the rotating shaft of the fourth gear 22.

The fifth gear 23*a* provides only one rotating shaft at one side. The rotating shaft is inserted into the hole 28*a* and the opposite side of this gear 23*a* is flat. And, the first gear 21 has a smaller diameter gear portion 21*b* and a larger diameter step 21*c*, both of which are formed coaxially. A part of the flat side of the fifth gear 23*a* is in contact with the surface of the step 21*c* so as to allow the former to be slid on the latter. Hence, the fifth gear 23*a* is arranged to have one side fitted into the hole 28*a* and the other side pressed against the step 21*c*.

In FIG. 7, 1*b* denotes a section for holding spiral spring 26.

Figure 8:
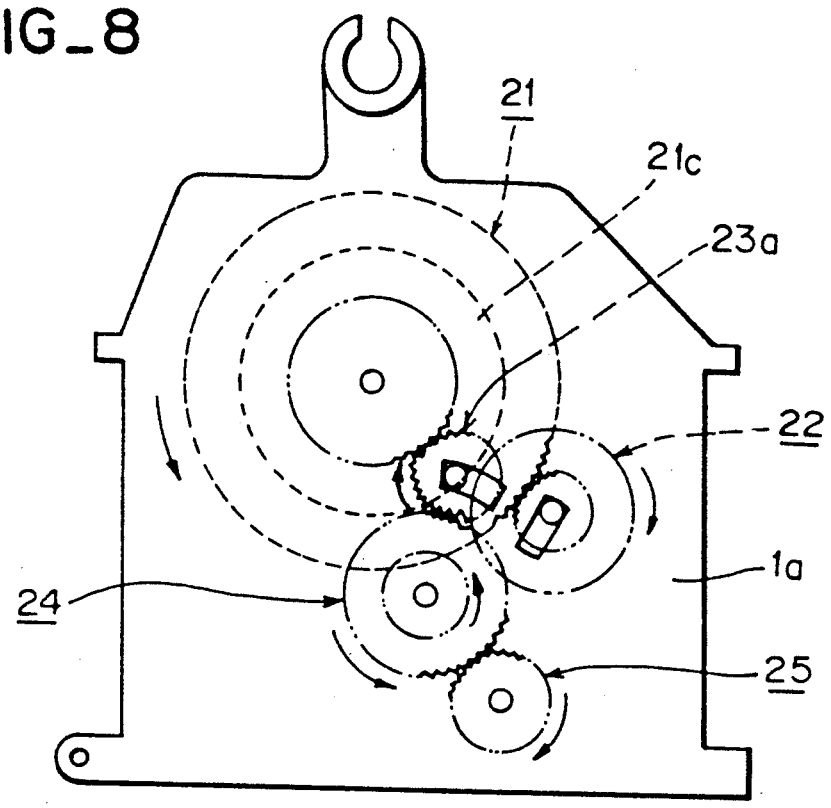

FIGS. 8 and 9 illustrate the operation of a gear mechanism according to the present embodiment. FIG. 8 illustrates the state where a driving wheel is rotated backward for winding up the spiral spring 26. FIG. 9 illustrates the state where the spiral spring provides the restoring force causing the doll toy itself to travel. In this embodiment, each gear basically operates in the same manner as that in the foregoing embodiment, except that the flat portion of the fifth gear 23*a* partially comes into contact with the surface of the step 21*c* of the first gear 21 in any state.

According to this embodiment, the partition plate 20 is eliminated from the gear housing it is therefore possible to reduce the number of parts and make the toy less costly as well as make the housing narrower by a thickness of the partition plate 20. In addition, it offers high efficiency for transmitting rotation as a result of narrowing the gaps between respective gears.

In the above embodiments the "means for engaging the fixed pin(of the wheel shaft) with the leg portion" is a longitudinal groove 16 on the rear side of the leg portion in which that pin is engaged.

Also the "means for engaging the crank with the cam" consists of another fixed pin 7 mounted on the crank 5 of a leg portion and the cutout portion 10 in the cam 9.

It will be understood that each of the elements described above, or two or more together, may also find a useful application in other types of structures differing from the types described above.

While the invention has been illustrated and described as embodied in a spiral-spring-driven doll toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. A spiral spring-driven doll toy, comprising:

a housing having an upper portion and a plurality of bearings in said upper portion, a gear mechanism provided within the housing, a spiral spring connected with the gear mechanism for driving the gear mechanism, a wheel shaft connected to the gear mechanism to be rotated by the gear mechanism, two wheels fixed to said wheel shaft, said gear mechanism being structured so that said spiral spring is wound up by rotating said wheels backward and said wheels are rotated forward by said spiral spring when said wheels are released, a wheel pin attached to each of said wheels eccentrically relative to said wheel shaft and extended in an axial direction from each of said wheels, a plurality of leg portions rotatably mounted on said housing, each of said leg portions having a laterally extended leg pin and each of said leg portions having a groove therein for engagement with one of said wheel pins structured so that said leg portions are rotated to and fro when said wheels rotate, and a plurality of arm portions, each of said arm portions having an individual arm shaft insertable in one of said bearings for rotatably mounting said arm portions on said housing, each of said arm portions also having an engaging piece with a recess and one of said leg pins engaging in said recess of one of said engaging pieces so when said leg portions are rotated to and fro said arm portions rotate oppositely to said leg portions.

2. A doll toy according to claim 1, wherein said bearings are each provided with a bearing cutout and said arm shafts are set under pressure in said bearings via said cutouts, each of said arm portions being formed with a stop at an end portion of said arm portion.

3. A doll toy according to claim 1, wherein said gear mechanism in said housing comprises a first gear linked with said spiral spring, a second gear fixed on the wheel shaft, a third gear being engaged with said second gear, a fourth gear being engagable with said first and third gears, and a fifth gear being engagable with said first and third gears, said fourth and fifth gears being displaceable, and, when said driving wheel is rotated backward, said fifth gear being engaged with said third and first gears for winding up said spiral spring and said fourth gear being detached from said third gear so as to allow said fourth gear to idle, and, when said spiral spring causes said first gear to be reversely rotated, said fifth gear being detached from said first gear and said fourth gear being engaged with said first and third gears to rotate said driving wheel by said second gear, and, wherein said housing is provided with a side wall and said first gear comprises a larger diameter gear portion, a smaller diameter gear portion and a step having a larger diameter than that of said small diameter gear, said fifth gear being mounted cantilevered from said side wall on one side of said fifth gear and slidably pressed by said step at another side of said fifth gear.

* * * * *